US011703197B2

(12) United States Patent
Westenfelder, II et al.

(10) Patent No.: US 11,703,197 B2
(45) Date of Patent: Jul. 18, 2023

(54) LIGHTING ASSEMBLY AND LIGHT HEAD INCLUDING SAME

(71) Applicant: American Sterilizer Company, Mentor, OH (US)

(72) Inventors: David A. Westenfelder, II, Mantua, OH (US); Michael Hollopeter, Kirtland, OH (US); Jill A. Sanders, Cleveland, OH (US); Martin R. Kraig, Mentor, OH (US)

(73) Assignee: American Sterilizer Company, Mentor, OH (US)

( * ) Notice: Subject to any disclaimer, the term of this patent is extended or adjusted under 35 U.S.C. 154(b) by 0 days.

(21) Appl. No.: 17/161,605

(22) Filed: Jan. 28, 2021

(65) Prior Publication Data

US 2021/0239281 A1 Aug. 5, 2021

Related U.S. Application Data

(60) Provisional application No. 62/968,551, filed on Jan. 31, 2020.

(51) Int. Cl.
*F21V 5/04* (2006.01)
*F21S 8/06* (2006.01)
(Continued)

(52) U.S. Cl.
CPC ..... *F21S 8/063* (2013.01); *F21V 5/046* (2013.01); *F21V 21/28* (2013.01);
(Continued)

(58) Field of Classification Search
CPC . F21V 5/046; F21Y 2103/033; F21Y 2105/18
See application file for complete search history.

(56) References Cited

U.S. PATENT DOCUMENTS 4,091,441 A 5/1978 Ott
5,539,626 A 7/1996 Scholz
(Continued)

FOREIGN PATENT DOCUMENTS

CN 207584408 U 7/2018
WO 2005012785 A1 2/2005
WO 2019067417 A1 4/2019

OTHER PUBLICATIONS

PCT/US2021/015583; Written Opinion of the International Preliminary Examining Authority dated Jan. 14, 2022.
(Continued)

*Primary Examiner* — Sean P Gramling
(74) *Attorney, Agent, or Firm* — Renner, Otto, Boisselle & Sklar, LLP

(57) ABSTRACT

A lighting assembly includes a light transmissive substrate extending along a length and including a light emission portion including opposed first and second major surfaces spaced apart from one another in a thickness direction, an inner edge surface extending between the first and second major surfaces in the thickness direction, and an outer edge surface opposed the inner edge surface and extending in the thickness direction. An extension portion extends from the light emission portion proximate the second major surface in the thickness direction. A light source is attached to the extension portion. A light head includes a housing, a primary light source attached to the housing, and the lighting assembly as an auxiliary lighting assembly. The housing includes a channel in which the auxiliary lighting assembly is retained.

21 Claims, 12 Drawing Sheets

(51) Int. Cl.

| | |
|---|---|
| ***F21V 21/28*** | (2006.01) |
| *F21Y 105/18* | (2016.01) |
| *F21Y 115/10* | (2016.01) |
| *F21V 33/00* | (2006.01) |
| *F21W 131/20* | (2006.01) |

(52) U.S. Cl.
CPC ..... *F21V 33/0068* (2013.01); *F21W 2131/20* (2013.01); *F21Y 2105/18* (2016.08); *F21Y 2115/10* (2016.08)

(56) References Cited

U.S. PATENT DOCUMENTS

| | | | | |
|---|---|---|---|---|
| 6,132,062 | A | 10/2000 | Borders et al. | |
| 6,642,659 | B1 | 11/2003 | Hsieh | |
| 6,851,832 | B2 | 2/2005 | Tieszen | |
| 6,863,422 | B2 | 3/2005 | Jesurun et al. | |
| 7,311,410 | B2 | 12/2007 | Marka | |
| 7,980,738 | B2 | 7/2011 | Chiang | |
| 8,215,786 | B2 | 7/2012 | Sloan et al. | |
| 8,308,333 | B2 | 11/2012 | Fritze et al. | |
| 8,388,180 | B2 | 3/2013 | Chang et al. | |
| 9,062,845 | B1 * | 6/2015 | Tsai ..... | B60Q 1/0052 |
| 9,157,622 | B2 | 10/2015 | Yanping | |
| 9,279,544 | B1 | 3/2016 | Dankelmann et al. | |
| 9,328,904 | B2 | 5/2016 | Volkenand et al. | |
| 9,622,314 | B1 | 4/2017 | Li | |
| 9,643,043 | B1 | 5/2017 | Moore | |
| 2003/0161152 | A1 | 8/2003 | Jesurun et al. | |
| 2006/0082997 | A1 | 4/2006 | Derrien et al. | |
| 2008/0304281 | A1 | 12/2008 | Scholz | |
| 2009/0316394 | A1 | 12/2009 | Fritze et al. | |
| 2011/0007506 | A1 * | 1/2011 | Kinoshita ..... | G02B 6/0096 362/296.01 |
| 2011/0260598 | A1 | 10/2011 | Liu | |
| 2013/0051046 | A1 | 2/2013 | Yeh | |
| 2014/0198489 | A1 | 7/2014 | Schlueter | |
| 2015/0204489 | A1 | 7/2015 | Baello | |
| 2017/0023192 | A1 | 1/2017 | Moita | |
| 2017/0268732 | A1 | 9/2017 | Camarota | |
| 2017/0296291 | A1 | 10/2017 | Barlund | |
| 2018/0116754 | A1 | 5/2018 | Hollopeter et al. | |
| 2018/0293854 | A1 | 10/2018 | Veira et al. | |
| 2018/0293855 | A1 | 10/2018 | Veira et al. | |

OTHER PUBLICATIONS

PCT/US2021/015583; PCT International Search Report and Written Opinion of the International Searching Authority dated May 3, 2021.

* cited by examiner

LIGHTING ASSEMBLY AND LIGHT HEAD INCLUDING SAME

This application claims priority to U.S. Patent Application No. 62/968,551 filed Jan. 31, 2020. This prior application is incorporated herein by reference.

FIELD OF THE INVENTION

The technology of the present disclosure relates generally to a lighting assembly, and more specifically to a light head for a medical device support system, suspension system, and/or carry system including the lighting assembly.

BACKGROUND

Light heads for medical device support systems, suspension systems and/or other carry systems, are used in health treatment settings such as hospital examination rooms, clinics, surgery rooms and emergency rooms to illuminate a target surface (e.g., surgical treatment site or other medical site) below or proximate the light head. A light head typically includes a housing and a lighting assembly attached to the housing and arranged to direct light emitted by the lighting assembly toward the target surface in accordance with the positioning of the light head. In some embodiments, a handle is mounted to the housing to enable a healthcare professional or other individual to adjust the position of the light head.

In these health treatment settings there is often a need for auxiliary lighting that may provide lower level illumination as compared with the light emitted by the lighting assembly toward the target surface. This lower level illumination may, for example, be used for ambient lighting, endo procedures, task lighting, accent lighting, and the like.

However, conventional light heads typically only emit light for purposes of illuminating the surface of a patient, and this lower level illumination is typically provided using separate, additional components of the medical device support system, suspension system, and/or other carry system. And while attempts have been made to incorporate one or more light emitting elements into a light head to provide this auxiliary lighting in addition to light for illuminating the target surface, light output distribution and/or luminance of the auxiliary lighting be an issue.

SUMMARY OF INVENTION

The present disclosure relates to a lighting assembly and to a light head including the lighting assembly. The lighting assembly of the present disclosure may provide illumination for purposes such as ambient lighting, endo procedures, task lighting, accent lighting, and the like. The lighting assembly may be included as a part of the light head as an auxiliary or additional lighting assembly to allow the light head to emit both light for purposes of illuminating a target surface (e.g., surgical treatment site or other medical site) and light for purposes of providing low level illumination.

In accordance with one aspect of the present disclosure, a light head includes: a housing; a primary light source attached to the housing; and an auxiliary lighting assembly attached to the housing, the auxiliary lighting assembly comprising: a light transmissive substrate extending along a length and comprising: a light emission portion comprising opposed first and second major surfaces spaced apart from one another in a thickness direction, an inner edge surface extending between the first and second major surfaces in the thickness direction, and an outer edge surface opposed the inner edge surface and extending in the thickness direction; and an extension portion extending from the light emission portion proximate the second major surface in the thickness direction; and a light source attached to the extension portion, wherein the housing comprises a channel in which the auxiliary lighting assembly is retained, the inner edge surface of the light emission portion in contact with a side surface of the channel, the outer edge surface of the light emission portion in contact with an opposed side surface of the channel, and the light source disposed within the channel.

In some embodiments, the primary light source is arranged proximate a first side of the housing; and the auxiliary lighting assembly is arranged proximate a second side of the housing opposite the first side.

In some embodiments, the extension portion extends orthogonal to the major surfaces of the light emission portion.

In some embodiments, a cross-section of the light transmissive substrate is an L shape.

In some embodiments, the light source is disposed in the channel and arranged to emit light in a direction orthogonal to an axial direction of the housing.

In some embodiments, the channel comprises opposed side surfaces and a bottom surface, at least one of the opposed side surfaces being a diffusively reflective surface.

In some embodiments, the inner edge surface of the light emission portion comprises a protrusion, and one of the side surfaces of the channel comprises a recess that mates with the protrusion.

In some embodiments, the light transmissive substrate and the channel are each annular in shape.

In some embodiments, the inner edge surface defines an orifice through the light emission portion.

In some embodiments, the light transmissive substrate is formed of two or more segments.

In some embodiments, the light transmissive substrate is formed of a single, monolithic piece.

In some embodiments, the light source comprises LEDs.

In some embodiments, the light transmissive substrate is a diffusive material.

In some embodiments, the light transmissive substrate extends along the length in a closed loop.

In some embodiments, the light transmissive substrate extends along the length between respective ends.

In some embodiments, the auxiliary lighting assembly is retained in the channel by an interference fit.

In some embodiments, the auxiliary lighting assembly is retained in the channel by one or more fasteners.

In some embodiments, the auxiliary lighting assembly is retained in the channel by adhesive.

In accordance with another aspect of the present disclosure, a light head includes: a housing defining a central axis; a channel defined by the housing and comprising opposed side surfaces and a bottom surface, the channel extending along a path in a plane orthogonal the central axis, at least one of the opposed side surfaces being a diffusively reflective surface; an auxiliary lighting assembly retained in the channel, the auxiliary lighting assembly comprising: a light source disposed in the channel and arranged to emit light in a direction orthogonal to the central axis and toward one of the opposed side surfaces of the channel; and a light transmissive substrate comprising opposed first and second major surfaces spaced apart from one another in a thickness direction, an inner edge surface extending between the first and second major surfaces in the thickness direction, and an outer edge surface opposed the inner edge surface and extending in the thickness direction, the inner edge surface of the light transmissive substrate in contact with one of the opposed side surfaces of the channel, the outer edge surface of the light transmissive substrate in contact with the other of the side surfaces of the channel.

In some embodiments, the light head further includes a primary light source attached to the housing.

In some embodiments, the primary light source is arranged proximate a first side of the housing; and the auxiliary lighting assembly is arranged proximate a second side of the housing opposite the first side.

In some embodiments, a cross-section of the light transmissive substrate is an L shape.

In some embodiments, the first and second major surfaces of the light transmissive substrate define a light emission portion, and an extension portion extending from the light emission portion proximate the second major surface in the thickness direction.

In some embodiments, the inner edge surface extending between the first and second major surfaces in the thickness direction defines an orifice through the light emission portion.

In some embodiments, the light source is attached to the extension portion.

In some embodiments, the light source is attached to the one of the opposed side surfaces.

In some embodiments, the path is a closed loop.

In some embodiments, the path extends between respective ends.

In some embodiments, the auxiliary lighting assembly is retained in the channel by an interference fit.

In some embodiments, the auxiliary lighting assembly is retained in the channel by one or more fasteners.

In some embodiments, the auxiliary lighting assembly is retained in the channel by adhesive.

These and further features will be apparent with reference to the following description and attached drawings which set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings. The invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

BRIEF DESCRIPTION OF THE DRAWINGS

The annexed drawings, which are not necessarily to scale, show various aspects of the present disclosure.

DETAILED DESCRIPTION

Figure 1:
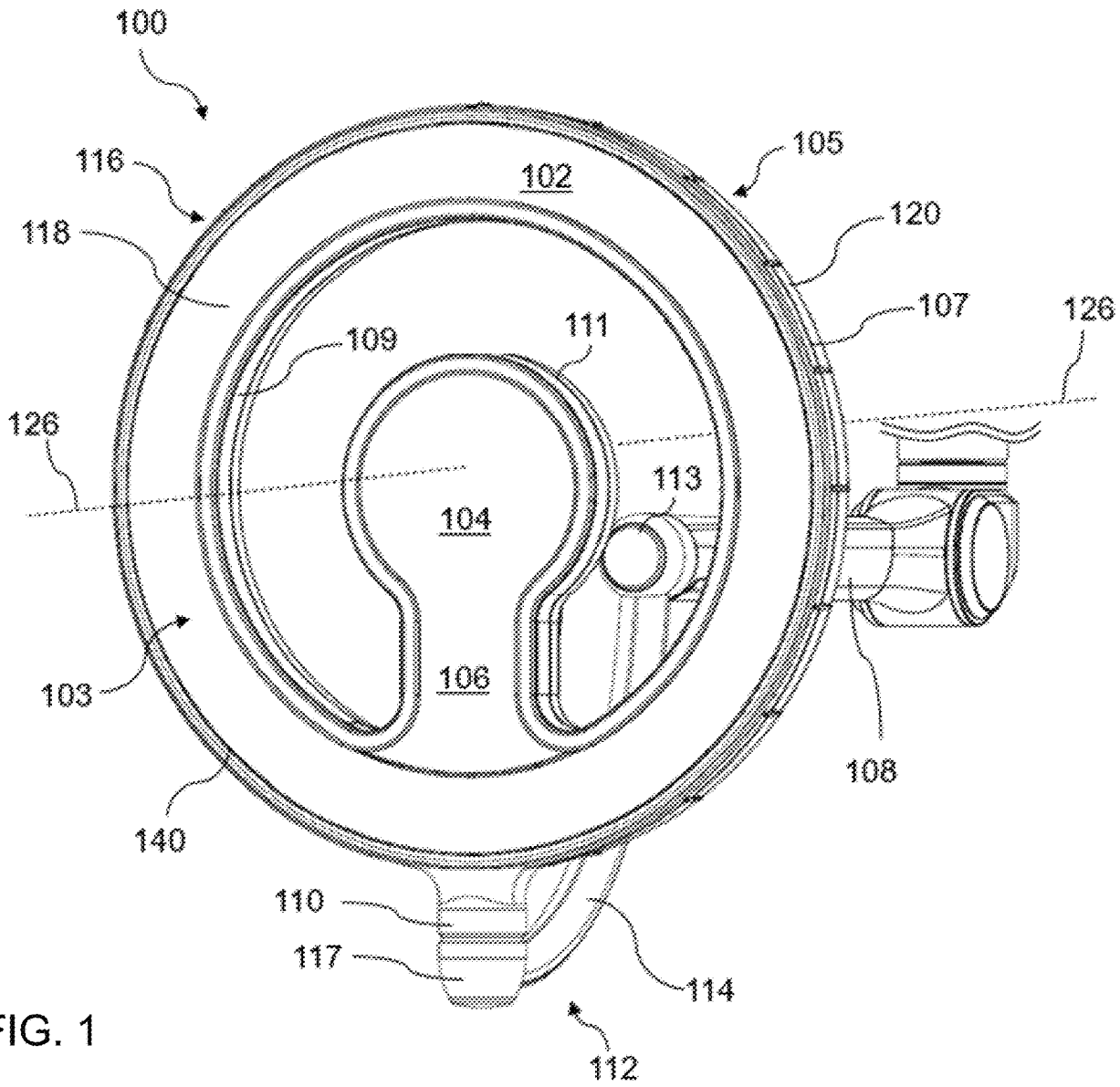
FIGS. 1 and 2 are perspective views of an exemplary light head attached to an arm of an exemplary medical device support system.

For the purpose of promoting an understanding of the principles of the present disclosure, reference will now be made to the embodiments illustrated in the drawings and specific language will be used to describe the same. It will nevertheless be understood that no limitation of the scope of the present disclosure is thereby intended. The figures are not necessarily to scale. Features that are described and/or illustrated with respect to one embodiment may be used in the same way or in a similar way in one or more other embodiments and/or in combination with or instead of the features of the other embodiments. Any alterations and further modifications of the described embodiments, and any further applications of the principles of the present disclosure as described herein, are contemplated as would normally occur to one skilled in the art to which the present disclosure relates.

Figure 2:
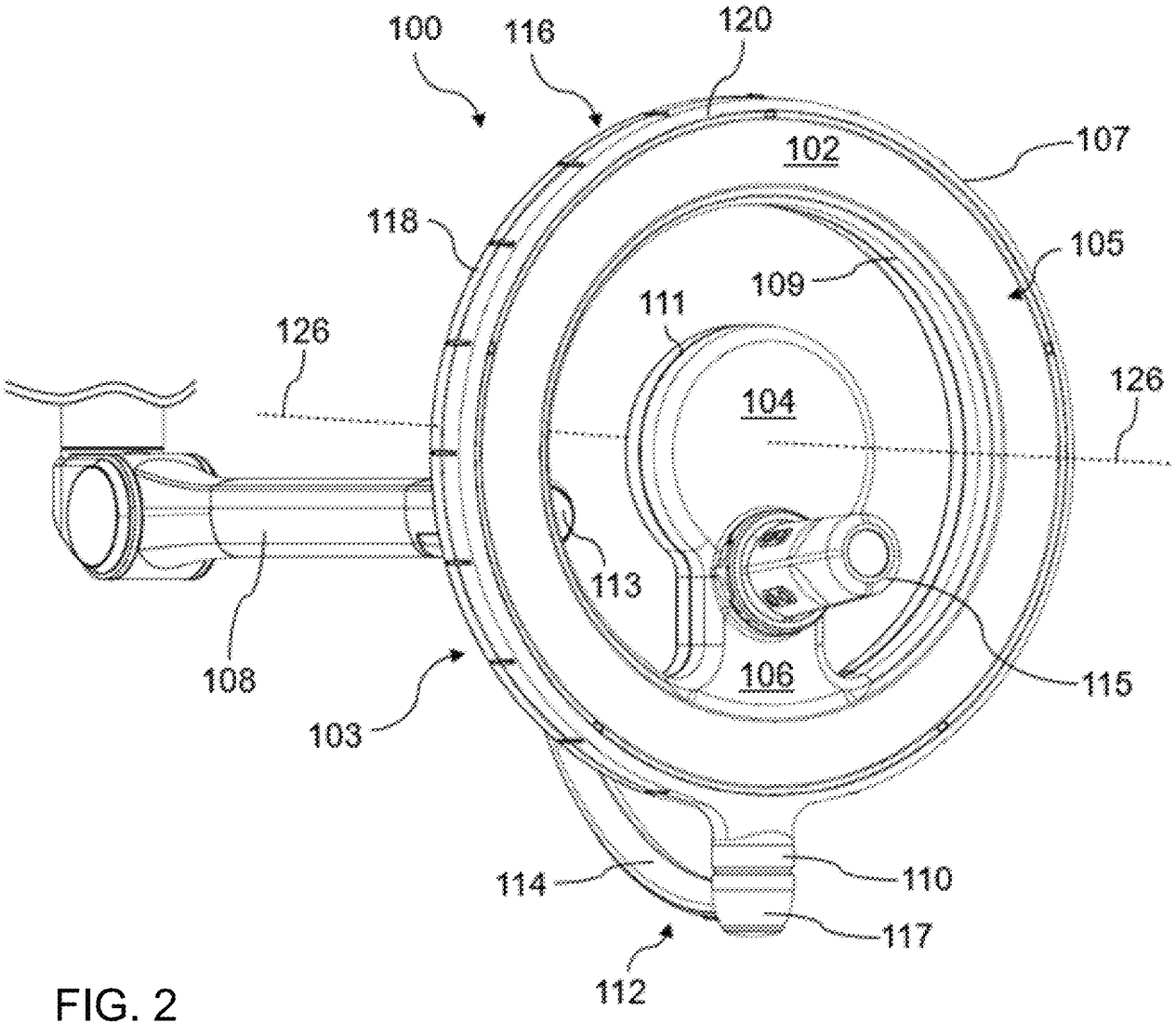
Figure 3:
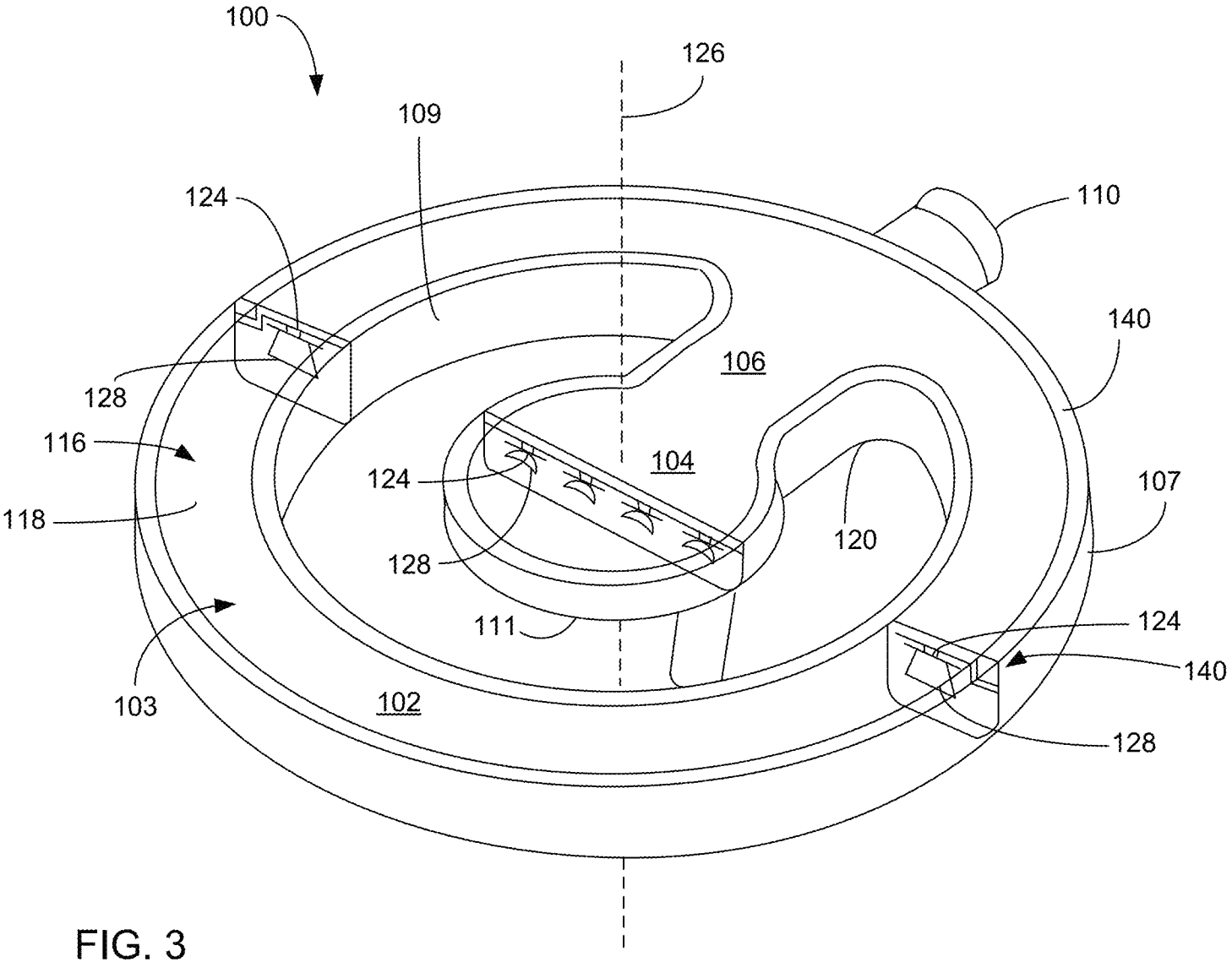
FIG. 3 is a perspective view of the exemplary light head of FIGS. 1 and 2 and including a superimposed cross section.

With reference to FIGS. 1-3, a light head is shown at 100. The light head 100 includes an annular shape outer portion 102, an inner portion 104, and a connecting portion 106 that connects the annular shape outer portion 102 to the inner portion 104. The outer perimeter 107 of the annular shape outer portion 102 defines the outer perimeter of the light head 100. In the example shown, the outer perimeter of the light head has a circular shape. In other embodiments, the outer perimeter of the light head may have any suitable shape (e.g., square, oval, pentagon, hexagon, octagon, or other polygonal shape).

In the illustrative embodiment, the connecting portion 106 arranges the annular shape outer portion 102 and the inner round portion 104 in concentric relation to one another. It will be appreciated that the annular shape outer portion 102 and the inner portion 104 need not be in concentric relation to one another. While the annular shape outer portion 102 is shown as having the profile of a circular tube, in other embodiments the profile of the annular shape outer portion 102 may be any suitable tubular shape (e.g., square, rectangle, oval, pentagon, hexagon, octagon, or other polygonal shape). It will also be appreciated that while the outer perimeter 111 of the inner portion 104 is shown as having a similar shape to the inner perimeter 109 of the annular shape outer portion 102 (e.g., circular in the embodiment shown), in other embodiments the outer perimeter 111 of the inner portion 104 may have a different shape than the inner perimeter 109 of the annular shape outer portion 102. As an example, the outer perimeter of the inner portion 104 may be a polygonal shape, whereas the inner perimeter of the annular shape outer portion 102 may be circular in shape.

It will be appreciated that the light head shown in FIGS. 1-3 is exemplary and that the overall shape and/or portions of the light head may be different in other implementations. For example, in some embodiments the inner portion 104 or both the inner portion 104 and connecting portion 106 may be omitted. In other examples, the light head may have the profile of a single solid body having a suitable outer perimeter shape (e.g., circle, square, rectangle, oval, pentagon, hexagon, octagon, or other polygonal shape).

The light head includes a first side 103 and a second side 105 opposite and spaced apart from the first side 103 in an axial direction 126. The above-referenced profiles and perimeters of the light head and portions thereof are the profiles and perimeters as viewed along the axial direction 126.

The light head 100 may be supported by a suitable support system, suspension system, and/or other carry system. For example, FIGS. 1 and 2 show a light head 100 attached to load balancing arm 108 via a yoke assembly 112. In the exemplary embodiment shown, the light head includes a bushing or other coupling member 110 that rotatably connects the light head 100 to the distal end 117 of an arm 114 of the yoke assembly 112. The distal end of the load balancing arm 108 is coupled to the proximal end 113 of the arm 114 of the yoke assembly 112. The load balancing arm 108 may be coupled to other components of the support system, suspension system, and/or other carry system, such as a horizontal extension arm (not shown), which may be mounted to a central shaft or support column (not shown). The central shaft or support column may be suspended from the ceiling or from another suitable mounting surface. The distal end of the load balancing arm 108 may be configured with yoke assembly 112 to support the light head 100 for multi-axis movement relative to the load balancing arm 108. For example, the FIG. 1 shows an example in which the first side 103 of the light head 100 is facing away from the load balancing arm 108. FIG. 2 shows an example in which the second side 105 of the light head 100 is facing away from the load balancing arm 108. The load balancing arm 108 and yoke assembly 112 may enable positioning of the light head 100 to a proper orientation relative to, for example, a patient operating table. The light head may include a handle 115 for positioning the light head.

The light head 100 includes a housing 116 that retains components of the light head 100. In some embodiments, the housing includes two or more portions that collectively form the housing 116. In the exemplary embodiment shown, and with additional reference to FIGS. 4 and 5, the light head 100 includes a housing base 118 and a housing cover 120, which together define an overall form and structure of the light head 100. In other embodiments, the housing may be a single component.

The light head 100 includes a lighting assembly 123 attached to the housing and arranged to direct light emitted by the lighting assembly 123 toward a target surface in accordance with the positioning of the light head. The lighting assembly 123 may also be referred to as a primary lighting assembly. With specific reference to FIGS. 3-5, the lighting assembly 123 includes light sources 124. In the exemplary embodiment, the light sources 124 are secured to the house base and are arranged such that light emitted therefrom is emitted from the second side 105 of the light head. The lighting assembly 123 may be attached to the housing by one or more fasteners (e.g., adhesive, screws, clamps, and the like). In the embodiment shown, the light sources 124 attached to the housing base 118 are enclosed within the housing 116 between the housing base 118 and the housing cover 120. An inside surface 119 of the housing base 118 supports the light sources 124. Light emitted from the light sources 124 passes through the housing cover 120 and are emitted from the second side 105 of the light head 100. In other embodiments having different configurations of the housing 116, the light sources 124 may be attached to the housing in any suitable manner. For example, in embodiments in which the housing cover is omitted the light sources 124 may be attached to the housing and exposed to the surrounding environment.

The light sources 124 may in some embodiments include one or more solid-state light emitters. Exemplary solid-state light emitters include such devices as LEDs, laser diodes, and organic LEDs (OLEDs). The LEDs may be broad spectrum LEDs (e.g., white light emitters) or LEDs that emit light of a desired color or spectrum (e.g., red light, green light, blue light, or ultraviolet light). In other embodiments, the LEDs may be a mixture of broad-spectrum LEDs and LEDs that emit narrow-band light of a desired color, or a mixture of LEDs that emit different respective colors or spectrum. In some embodiments, the solid-state light emitters constituting the light sources 124 of the lighting assembly 123 all generate light having the same nominal spectrum. In other embodiments, at least some of the solid-state light emitters constituting the light sources 124 of the lighting assembly 123 generate light that differs in spectrum from the light generated by the remaining solid-state light emitters.

In other embodiments, the light sources 124 may include one or more other types of light sources. Non-limiting examples of light sources include halogen, fluorescent, compact fluorescent, incandescent, and the like. In still other embodiments, the light sources 124 may include a combination of solid-state light emitters and one or more of the above other types of light sources.

In the embodiment shown, collimators 128 are mounted to the inside surface 119 of the housing base 118 and in the light emitting paths of the respective of light sources 124. The collimators 128 collect and direct, and/or collimate, the light into beams. In one form, the collimators 128 may include total internal reflection (TIR) lenses.

The lighting assembly 123 may include one or more additional components. For example, the light sources may be mounted to a substrate such as a printed circuit board (PCB) or a flexible and/or conformable substrate. The lighting assembly 123 may additionally include circuitry, power supply, electronics for controlling and driving the light sources, and/or any other appropriate components. For example, a controller (not shown) may control the light sources 124 of the annular shape outer portion 102 and the inner portion 104 to emit light to a target surface below the light head 100. Control of the respective light sources 124 may be performed, for example, collectively, individually, in groups, by section, or in any other suitable manner.

In some embodiments, at least a portion of the housing cover 120 is light transmissive. Light emitted from light sources 124 of the lighting assembly 123 may pass through the housing cover 120 and may be emitted from the second side 103 of the light head. In some examples, the housing cover 120 is specularly transmissive (i.e., the housing cover 120 lacks an optical modifying characteristic, even though a specularly transmissive material may refract light that passes through a surface of the material at a non-zero angle of incidence). In other examples, the housing cover provides an optically modifying characteristic, which in some examples may modify the light ray angle distribution of the light incident thereon. For example, the housing cover may provide one or more elements (e.g., protrusions and/or recesses) shaped to refract light incident thereon in a predetermined manner.

Figure 4:
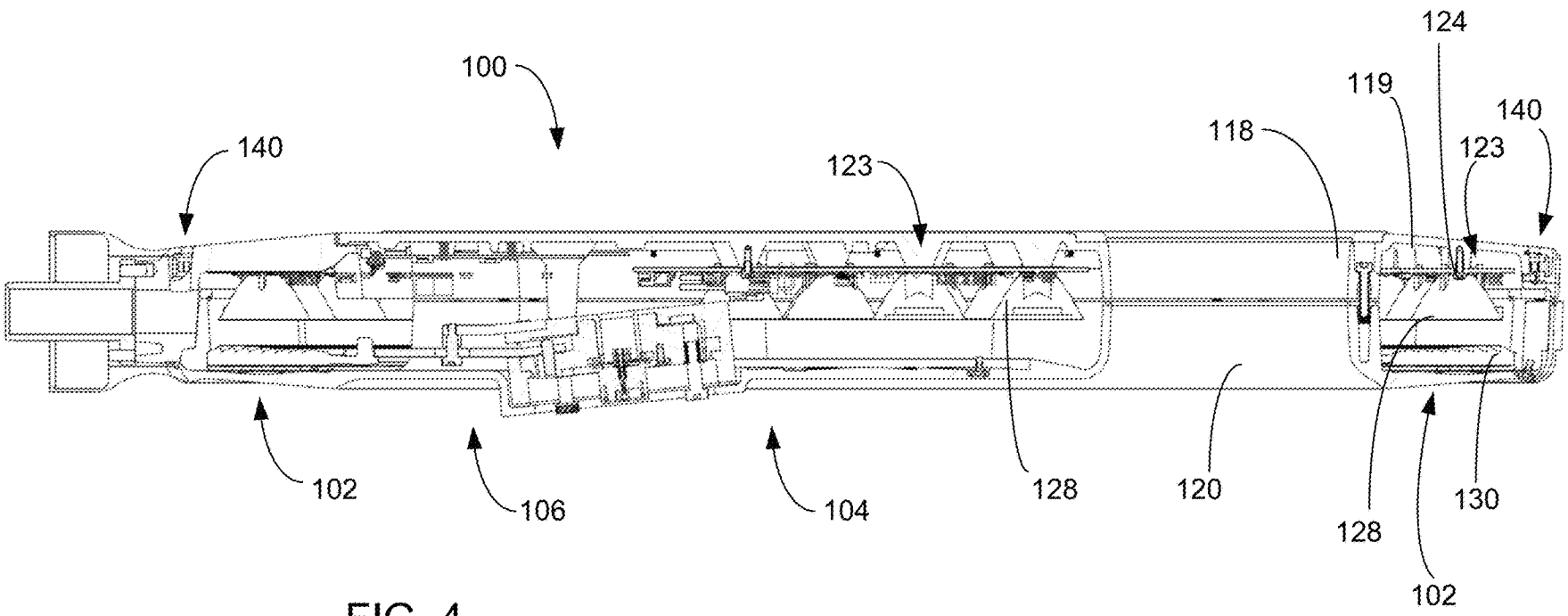
FIG. 4 is a side cross section view of the exemplary light head of FIGS. 1 and 2.
Figure 5:
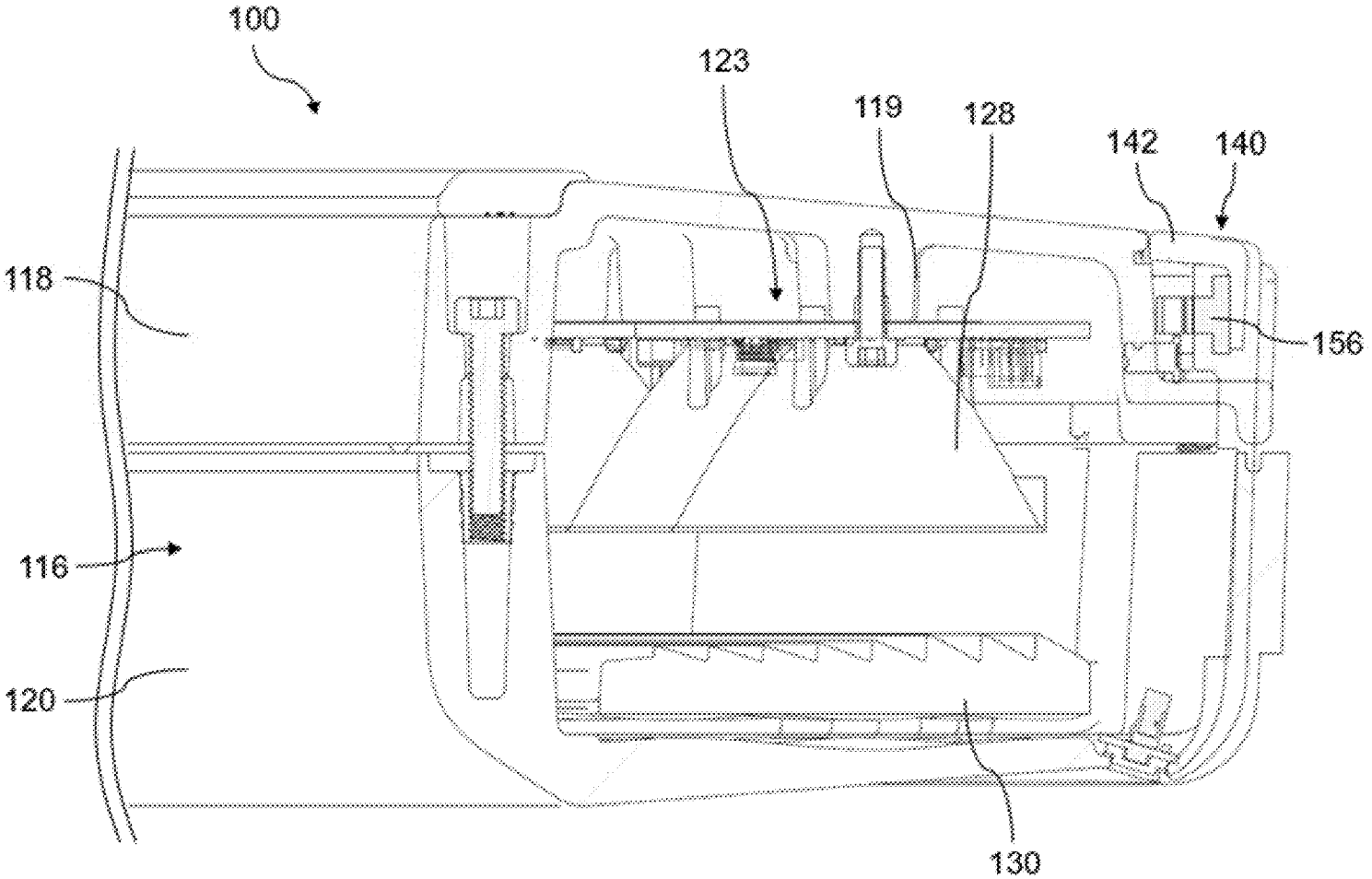
FIG. 5 is a side cross section view of part of the exemplary light head of FIGS. 1 and 2.
Figure 6:
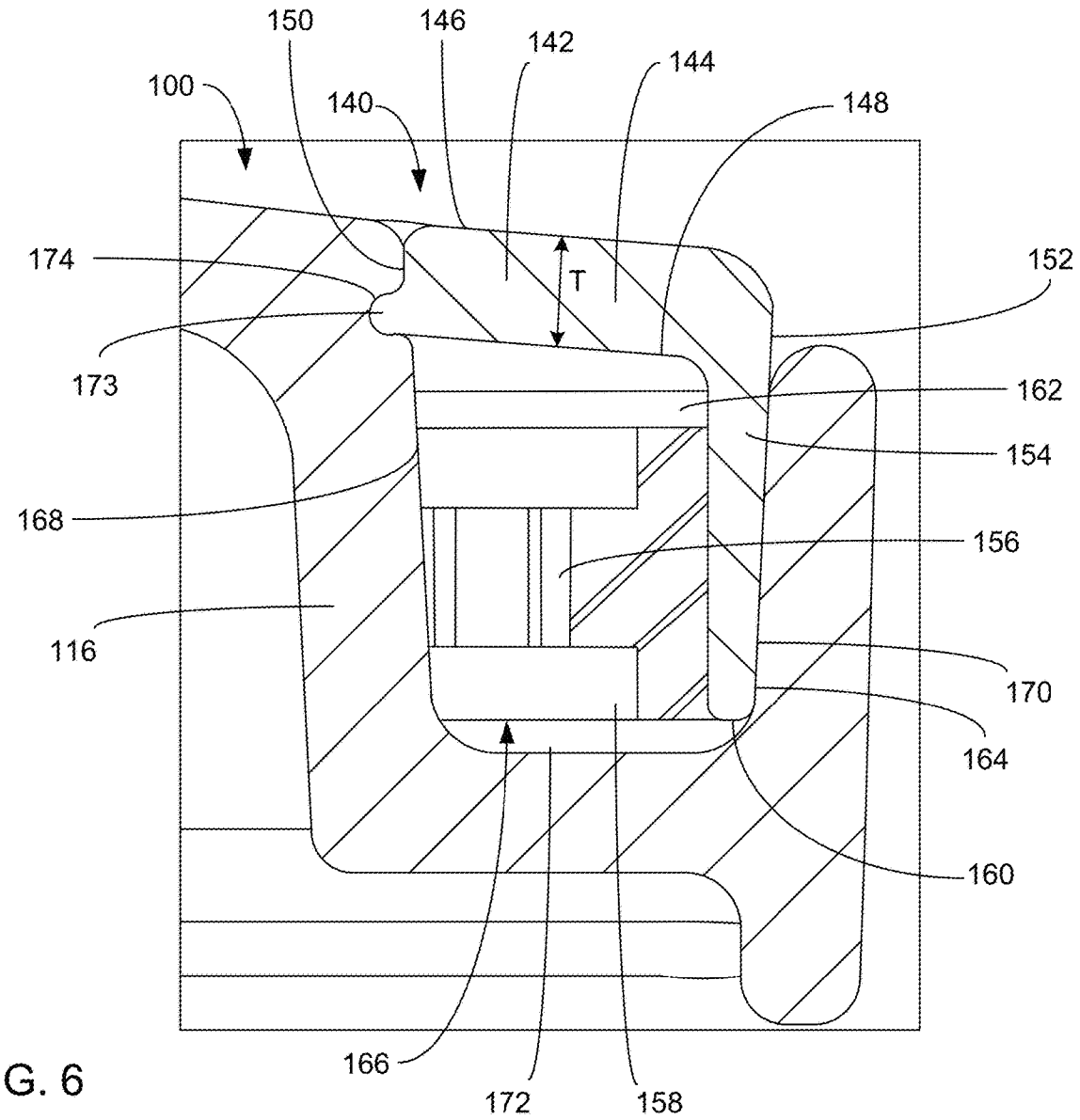
FIG. 6 is a side cross section view of part of the exemplary light head of FIGS. 1 and 2.
Figure 7:
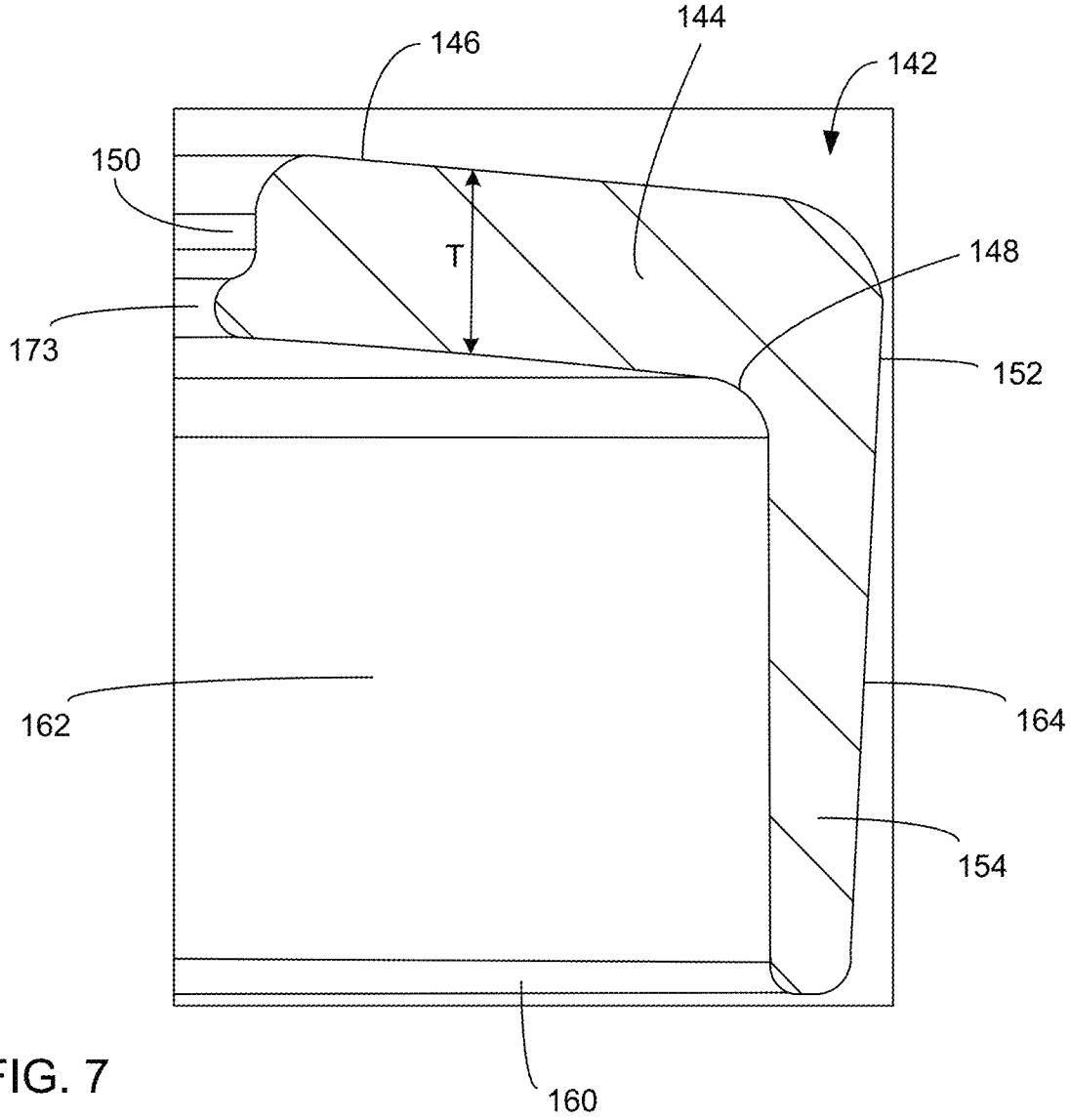
FIG. 7 is a perspective cross section view of an exemplary light transmissive substrate.

In some embodiments, and with reference to FIGS. 4 and 5, a lens 130 may be provided between the light sources 124 and the housing cover 120. The lens 130 may modify the light output distribution of light emitted from the light sources. For example, light emitted from the light sources 124 may be incident and pass through the lens 130, and such light may be refracted in a manner determined by the surface features of the lens. The lens 130 may be provided in a fixed position, or may be movable. In other embodiments, the lens 130 may be omitted from the light head.

With continued reference to FIGS. 1 and 3-7, the light head 100 includes an auxiliary lighting assembly 140 (additional lighting assembly) attached to the housing 116. In the exemplary embodiment, the auxiliary lighting assembly 140 is at least partially recessed in a channel 166 formed in the housing 116 (e.g., housing base 118) of the light head and is arranged such that light emitted therefrom is emitted from the first side 103 of the light head 100. While this assembly is referred to herein as an auxiliary lighting assembly, it will be appreciated that such assembly may instead simply be referred to as a lighting assembly, as inclusion of this lighting assembly may be included in a device independent of the presence of another lighting assembly.

The auxiliary lighting assembly 140 includes a light transmissive substrate 142. The light transmissive substrate 142 includes a light emission portion 144 comprising a first major surface 146 and a second major surface 148 spaced apart from the first major surface 146 in a thickness direction T. The first major surface 146 may also be referred to as the light emitting surface of the light transmissive substrate. In some embodiments, the thickness direction T is parallel to the axial direction 126. An inner edge surface 150 extends between the first major surface 146 and the second major surface 148 in the thickness direction T. The inner edge surface of the light emission portion includes a protrusion 173 that, as exemplified in FIG. 6, may be used in connection with retention of the light transmissive substrate 142 by the housing. An outer edge surface 152 is opposed the inner edge surface 150 and extends in the thickness direction T.

The light transmissive substrate 142 includes an extension portion 154 that extends from the light emission portion 144 proximate the second major surface 148 in the thickness direction T to a distal end 160. The extension portion includes an inner surface 162 and an outer surface 164 opposite the inner surface 162. In some embodiments, the extension portion 154 extends orthogonal to one or both of the major surfaces 146, 148 of the light emission portion 144. The extension portion 154 may extend from the light emission portion 144 proximate the outer edge surface 152. As such, the outer surface 164 of the extension portion 154 may form a part of the outer edge surface 152. A cross-section of the light transmissive substrate may be an L shape. In other embodiments (not shown) the extension portion 154 may extend from the light emission portion 144 at a point along the second major surface between the inner edge surface 150 and the outer edge surface 152 such that a cross-section of the light transmissive substrate may be a T shape or offset T shape. In such embodiments, the outer surface 164 of the extension portion may be a different surface from the outer edge surface 152. In other embodiments (not shown), the extension portion 154 may be omitted.

At least a portion (e.g., at least the light emission portion) of the light transmissive substrate 142 may be an optically diffusive material. In other embodiments, all of the light transmissive substrate 142 is an optically diffusive material. In an example, the light transmissive substrate may include an optically diffusive surface or other light-scattering elements, which are typically features of indistinct shape or surface texture, such as printed features, ink-jet printed features, selectively-deposited features, chemically etched features, laser etched features, and so forth. In other embodiments, the material of the light transmissive substrate may include one or more diffusive components therein (e.g., pigments, particles, and the like). Light passing through the light transmissive substrate may be diffusively scattered.

Figure 8:
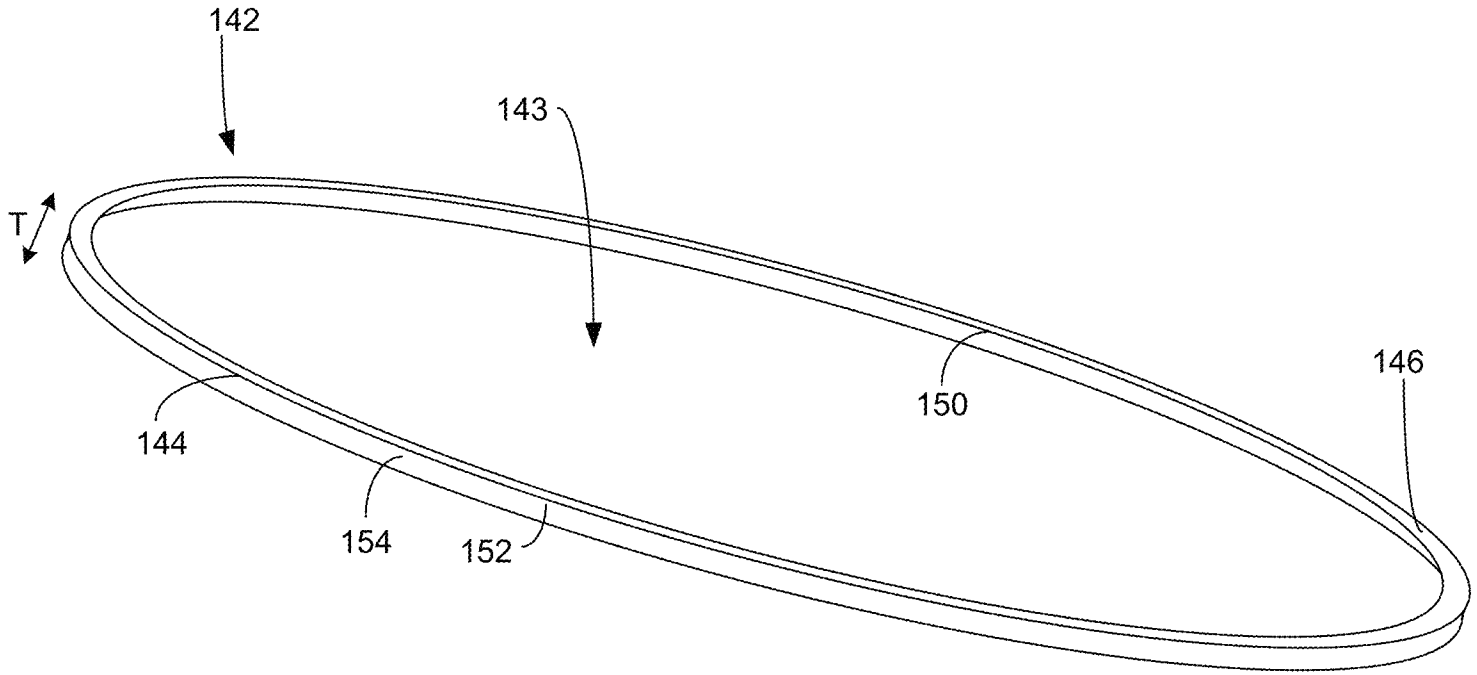
FIG. 8 is a top perspective view of an exemplary light transmissive substrate.

As shown in FIGS. 1, 3, and 8, the light transmissive substrate 142 may have an annular shape as viewed in the thickness direction T. The path of the transmissive substrate as viewed in the thickness direction T may form a closed loop. The inner edge surface 150 may define an inner perimeter of the light transmissive substrate 142 (and may define an orifice 143 through the light emission portion), and the outer edge may define an outer perimeter of the light transmissive substrate 142. While the light transmissive substrate 142 is shown as having the profile of a circular tube, in other embodiments the profile of the light transmissive substrate 142 may be any suitable tubular shape (e.g., square, rectangle, oval, pentagon, hexagon, octagon, other polygonal shape, or other shape). The profile of the light transmissive substrate 142 may correspond to the shape of a channel formed in the base (described below). The profile of the light transmissive substrate (and the channel) may be such that it extends along the rim (e.g., along the outer perimeter) of the light head.

In some embodiments, the light transmissive substrate is a single element. In other embodiments, the light transmissive substrate is comprised of two or more segments that form the overall light transmissive substrate. The segments may be coupled together or retained in a fixed relationship relative to one another when retained in the channel.

It will be appreciated that while the exemplary embodiment shows the light transmissive substrate 142 as having a closed loop, annular shape, other embodiments of the light transmissive substrate 142 may have a different shape. For example, a light transmissive substrate may be a linear or curved body that extends along a length between respective ends. One or more instances of such light transmissive substrate may be used instead of a closed loop, annular-shaped light transmissive substrate.

The auxiliary lighting assembly 140 includes light sources 156. The light sources 156 may in some embodiments be referred to as auxiliary light sources 156. In some embodiments, the light sources 156 are one or more solid-state light emitters. Exemplary solid-state light emitters include such devices as LEDs, laser diodes, and organic LEDs (OLEDs). In some embodiments, the LEDs are broad spectrum LEDs (e.g., white light emitters). In some embodiments, the LEDs are RGB devices that provide a full gamut of controllable colors. In some embodiments, the LEDs are devices that emit light of a desired color or spectrum (e.g., red light, green light, blue light, or ultraviolet light). In other embodiments, the LEDs may be a mixture of broad-spectrum LEDs and LEDs that emit narrow-band light of a desired color, or a mixture of LEDs that emit different respective colors or spectrum. In some embodiments, the solid-state light emitters constituting light source 156 all generate light having the same nominal spectrum. In other embodiments, at least some of the solid-state light emitters constituting light source 156 generate light that differs in spectrum from the light generated by the remaining solid-state light emitters.

Figure 9:
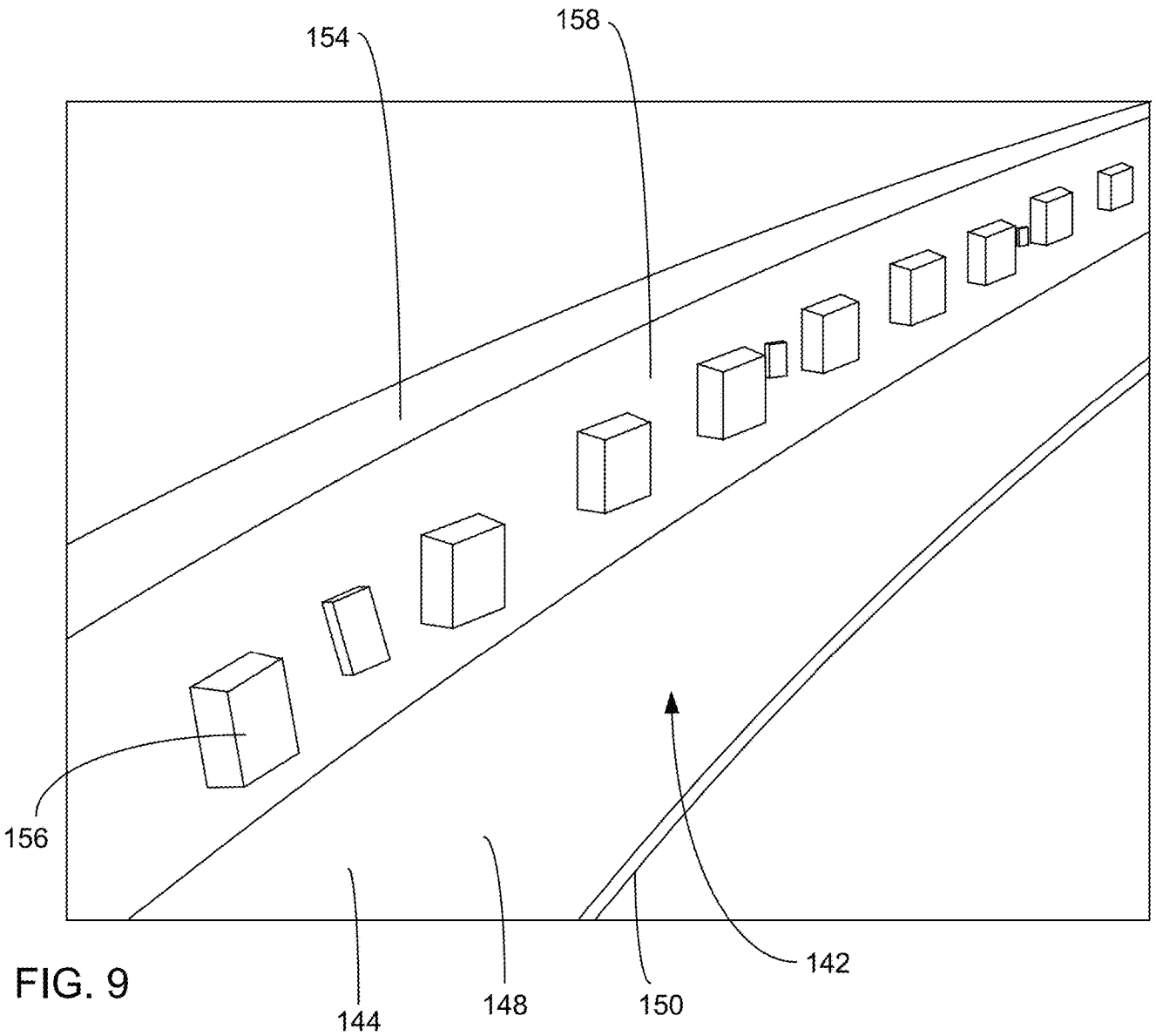
FIG. 9 is a bottom perspective view of parts of an exemplary auxiliary lighting assembly.

In the example shown, the light sources 156 are mounted to a substrate 158 such as a flexible and/or conformable substrate. As such, the light sources 156 may in some embodiments be implemented as LED strip lights. The LED strip light may have a flexible substrate that may allow LED circuits of the light source to conform to curved shapes. FIG. 9 shows an exemplary LED strip light including LED circuits attached to the extension portion of the auxiliary lighting assembly 140. In other embodiments, the light sources 156 may be mounted to a printed circuit board (PCB). The light sources 156 may be arranged linearly or in another suitable pattern along the extension portion. The light source 156 may additionally include circuitry, power supply, electronics for controlling and driving the solid-state light emitters 156, and/or any other appropriate components. In some embodiments, control of the light sources 156 may be performed by a controller that also controls the light sources 124. Control of the respective light sources 156 may be performed, for example, collectively, individually, in groups, by section, or in any other suitable manner.

In the embodiments shown, the light sources 156 are attached to the extension portion. The light sources 156 are attached to the inner surface 162 of the extension portion and are oriented to emit light primarily radially inward (e.g., toward the axis 126 of the light head). In other embodiments (not shown), the light sources 156 may be attached to a surface of the channel 166. For example, the size of the extension portion in the thickness direction may be such that a space is provided between the distal end 160 of the extension portion and the bottom surface 172 of the channel, and the light sources 156 (e.g., LED strip light including LED circuits) are attached to the side surface 170 of the channel in this space. In another example, the extension portion may be omitted and the light sources 156 (e.g., LED strip light including LED circuits) are attached to the side surface 170 of the channel.

In the embodiments shown, the light sources are oriented to emit light primarily radially inward. In other embodiments, the light sources 156 may be oriented to emit light radially outward. For example, the light sources 156 (e.g., LED strip light including LED circuits) may be attached to the side surface 170 of the channel. In another example, the extension portion may be offset from the outer edge surface and the light sources 156 may be mounted to the outer surface 164 of the extension portion.

Figure 10:
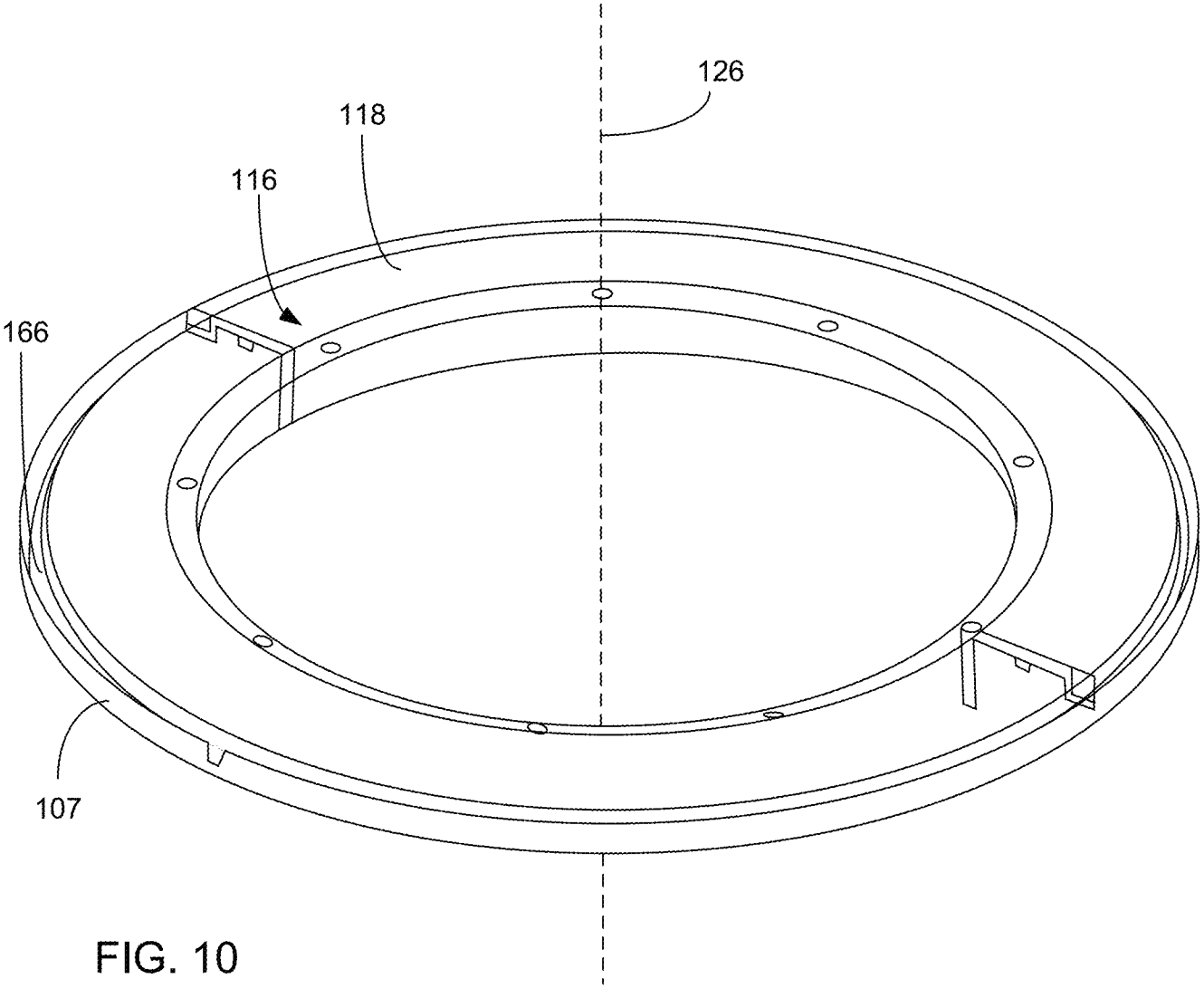
FIG. 10 is a top perspective view of parts of an exemplary housing of the light head of FIGS. 1 and 2 and including a superimposed cross section.
Figure 11:
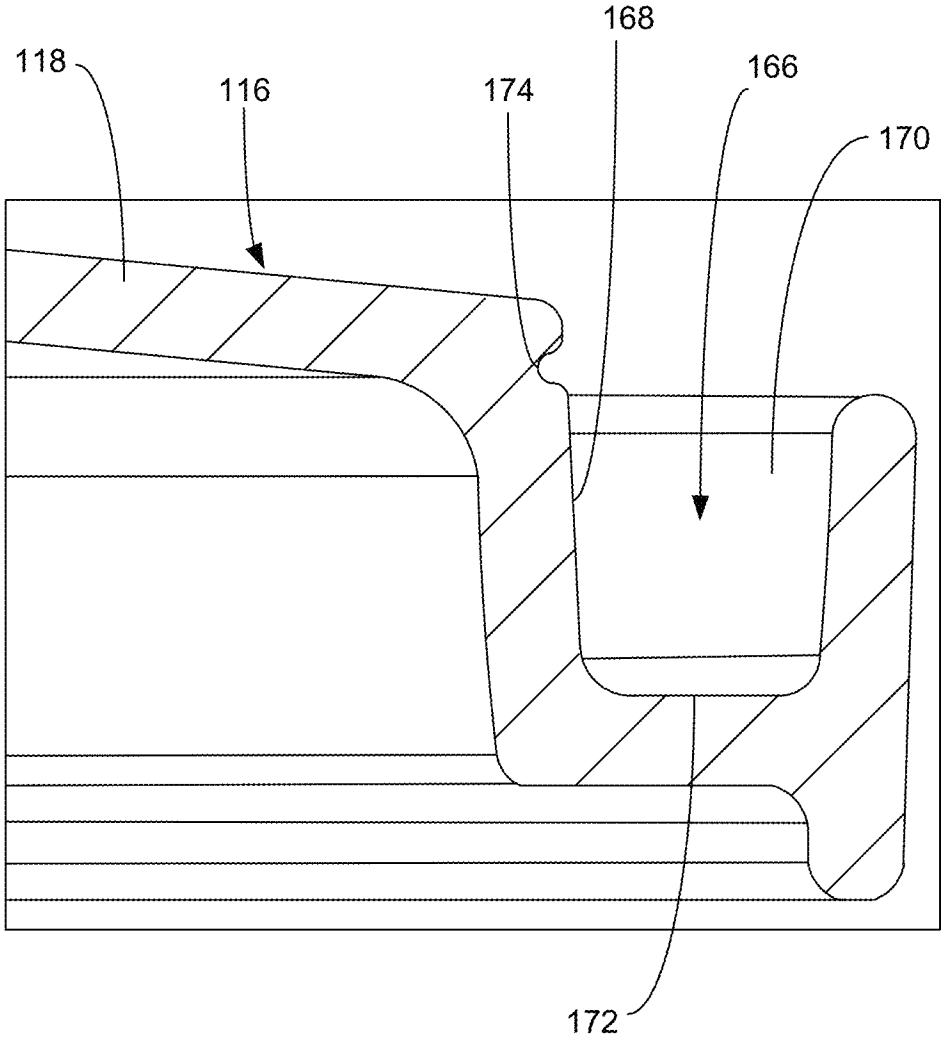
FIG. 11 is a perspective cross section view of parts of the exemplary housing of FIG. 10.

The housing 116 includes a channel 166 in which the auxiliary lighting assembly may be removably retained. With additional reference to FIGS. 10 and 11, the channel 166 includes opposed side surfaces 168, 170 and a bottom surface 172. The channel 166 extends along a path as viewed along the axial direction 126. The path may form a closed loop. In the embodiment shown, the channel 166 is proximate and extends along the rim (e.g., along the outer perimeter) of the light head. In other embodiments, the channel may follow a different path. For example, the channel may extend along a path other than the outer perimeter of the light head The side surface 168 of the channel may include a recess 174 that is arranged to mate with the protrusion 173 of the light transmissive substrate.

It will be appreciated that while the exemplary embodiment shows the channel 166 as having a closed loop, annular shape, other embodiments of the channel 166 may have a different shape. For example, the channel may be a linear or curved body that extends along a length between respective ends.

In some embodiments, fasteners that may be used to hold the base and the cover of the light head together may be disposed channel, which may hide the fasteners from view.

One or more of the surfaces 168,170,172 of the channel 166 is diffusively reflective. For example, at least one of the opposed side surfaces 168,170 are diffusively reflective surfaces. In another example, both of the opposed side surfaces 168,170 are diffusively reflective surfaces. In another example, one of the opposed side surfaces 168,170 and the bottom surface 172 are diffusively reflective surfaces. In another example, all of the surfaces of the channel 166, including the opposed side surfaces 168,170 and the bottom surface 172 are diffusively reflective surfaces. Light incident the diffusively reflective surface (e.g., light emitted from the light source 140) may be diffusively scattered. The diffusively reflective surface may be provided, for example, by a reflective coating on the surface.

In the exemplary embodiments shown, the light transmissive substrate 142 and the channel 166 are each annular in shape. The profile of the light transmissive substrate 142 and path (profile) of the channel may correspond to one another such that at least a portion of the auxiliary lighting assembly may be disposed in the channel, with the channel retaining the auxiliary lighting assembly. With exemplary reference to FIG. 6, the inner edge surface 150 of the light emission portion is in contact with the side surface 168 of the channel 166. The protrusion 173 of the inner edge surface 150 mates with the recess 174 of the side surface 168 of the channel. The side surface 170 of the channel 166 is in contact with the outer edge surface 152 of the light transmissive substrate 142. With the light transmissive substrate 166 formed having an L shape cross section, the outer surface 164 of the extension portion 154 also forms a part of the outer edge surface 152. An interference fit is created between the light transmissive substrate 142 and the channel 166 by which the light transmissive substrate is retained.

Upon insertion of the light transmissive substrate 142 into the channel, the protrusion 173 may snap into the recess 174 receiving feature. The integrity of the snap fit is ensured by a flush fit (interference fit) between the surface of the light transmissive substrate located opposite the protrusion and the side surface of the channel 166 opposite the recess. Accordingly, the auxiliary lighting assembly 140 may be attached to the housing by being retained in the channel (via the interference fit) The design of the auxiliary lighting assembly 140 may allow for the auxiliary lighting assembly to be attached to the housing of the light head without fasteners.

While embodiments described above describe the auxiliary lighting assembly 140 being attached to the housing by an interference fit, in other embodiments, one or more fasteners (e.g., adhesive, screws, clamps, and the like) may be used in addition to or as an alternative to the interference fit, such that the auxiliary lighting assembly is attached to the housing (e.g., retained in the channel) using said one or more fasteners. In such embodiments, the protrusion 173 and the recess 174 may or may not be present.

As assembled, the channel 166 is covered/enclosed by the light transmissive substrate 142. The light transmissive substrate 142 may provide an optically diffusive cover through which light from the auxiliary lighting assembly is emitted. The light transmissive substrate 142 may also seal the light sources from the external environment, allowing the light head to be cleaned with fluids. The light sources 156 are disposed within the channel 166 and arranged to emit light in a direction orthogonal to the axis direction 126 of the light head (e.g., in a direction orthogonal to the first side 103 of the light head. The combination of the light source orientation, the diffusely reflecting cavity, and the diffuse cover may significantly reduce or eliminate variations in intensity of light output from the auxiliary lighting assembly 140. With reference to the exemplary embodiment shown in the FIGS., this may provide the appearance of a uniformly illuminated ring of light around the rim of the light head. The light emitted from the auxiliary lighting assembly 140 may be colored light (e.g., green, red, or another suitable color) that may be used for lower level illumination as compared with the light emitted by the lighting assembly toward the target surface. This light may be bright enough to provide enough illumination to safely walk around and work in the room when the main room lights are turned off, as is often the case for endoscopic procedures. This light may also serve a decorative feature.

The orientation of the light sources 156 in the channel to emit light (e.g., primarily radially inward or outward) toward a side surface of the channel, rather than directly toward the diffuse cover, may help to improve the uniform luminance at the light emitting surface of the auxiliary lighting assembly 144. Light emitted from a light source 156 is incident a side surface of the channel 166 and is diffusively reflected within the channel. The light may continue to propagate and reflect (e.g., diffusely reflect) within the channel until it is incident the light emission portion 144 of the light transmissive substrate 142 at an angle where the light passes through the light emission portion of the light transmissive substrate (instead of totally internally reflecting). The light passing through the light emission portion may be further diffusively refracted by the light emission portion. This arrangement may allow for the light to spread and reduce the visual effect of hot spots associated with point light sources. The channel may in effect serve as a mixing chamber in which the light from the light sources 156 diffuses and blends before being emitted from the light head.

A challenge with the use of LED strip lights is achieving uniform luminance along a lit length. Even for strings with high linear density (e.g., pitch ~8 mm), it is still hard to avoid distinct bright spots ("hot spots") associated each LED. By orienting the LEDs toward the side surface of the channel, the effective separation between the LED and the cover may be increased, and uniformity of the light output through the light transmissive substrate may be improved. The combined utilization of the diffusively reflective channel surface(s) further aids in achieving the visual effect of a uniform luminance. The arrangement as shown may also allow for lower profile designs as compared with conventional approaches in which the LEDs are aimed directly at a diffusive cover.

Figure 12:
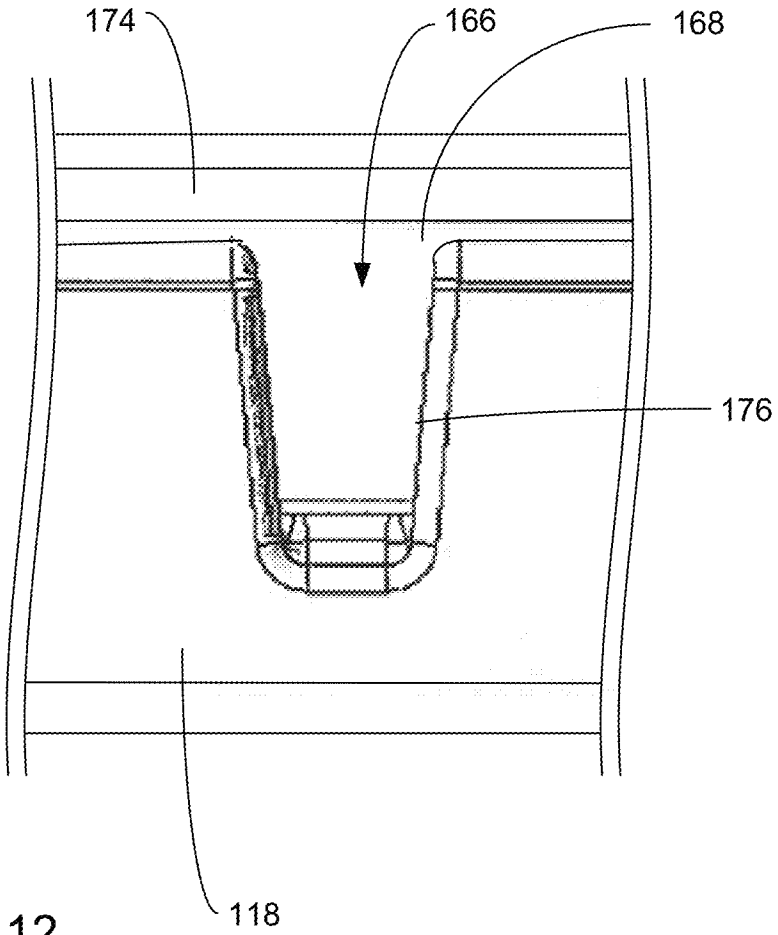
FIG. 12 is a side view of a part of the exemplary housing of FIG. 10.

As described above, the auxiliary lighting assembly is removably attached to the housing. With reference to FIG. 12, a slot 176 may be provided in the housing to remove the light transmissive substrate (and any other parts of the auxiliary lighting assembly attached thereto) from the light head. In some embodiments, a removal tool may be used to lift the lens out of the channel. In some embodiments, the extension portion also includes a corresponding slot (not shown) that may be aligned with the slot 176 of the housing. In such embodiments, the slot in the extension portion may allow the removal tool to contact the second major surface 148 of the light emission portion 144 to lift the light transmissive substrate 142 and overcome the snap fit. In some embodiments, the slot 176 may be hidden by an outer bumper.

While the embodiments of the lighting assembly 140 (auxiliary lighting assembly) has primarily been described above in connection with a light head, it will be appreciated that the lighting assembly 140 may be implemented in any other suitable product. Non-limiting examples include medical devices such as sterilizers, washers, disinfectors, surgical tables, equipment management systems (e.g., booms), case goods (e.g., warming cabinets), and the like.

Although the invention has been shown and described with respect to certain preferred embodiments, it is understood that equivalents and modifications will occur to others skilled in the art upon the reading and understanding of the specification and the attached drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application. The present invention includes all such equivalents and modifications and is limited only by the scope of the following claims.

What is claimed is:

1. A light head comprising:

a housing defining a central axis;

a channel defined by the housing and comprising opposed side surfaces and a bottom surface, the channel extending along a path in a plane orthogonal the central axis, at least one of the opposed side surfaces being a diffusively reflective surface;

an auxiliary lighting assembly retained in the channel, the auxiliary lighting assembly comprising:

a light source disposed in the channel and arranged to emit light primarily in a direction orthogonal to the central axis and toward one of the opposed side surfaces of the channel; and a light transmissive substrate comprising opposed first and second major surfaces spaced apart from one another in a thickness direction, an inner edge surface extending between the first and second major surfaces in the thickness direction, and an outer edge surface opposed the inner edge surface and extending in the thickness direction, the inner edge surface of the light transmissive substrate in contact with one of the opposed side surfaces of the channel, the outer edge surface of the light transmissive substrate in contact with the other of the side surfaces of the channel, the light transmissive substrate further comprising an extension portion extending from the second major surface in the thickness direction, wherein the light source is attached to the extension portion.

2. The light head of claim 1, further comprising a primary light source attached to the housing.

3. The light head of claim 2, wherein:

the primary light source is arranged proximate a first side of the housing; and the auxiliary lighting assembly is arranged proximate a second side of the housing opposite the first side.

4. The light head of claim 1, wherein a cross-section of the light transmissive substrate is an L shape.

5. The light head of claim 1, wherein the first and second major surfaces of the light transmissive substrate define a light emission portion.

6. The light head of claim 5, wherein the inner edge surface extending between the first and second major surfaces in the thickness direction defines an orifice through the light emission portion.

7. The light head of claim 1, wherein the path is a closed loop.

8. The light head of claim 1, wherein the path extends between respective ends.

9. A light head comprising:

a housing defining a central axis;

a channel defined by the housing and comprising opposed side surfaces and a bottom surface, the channel extending along a path in a plane orthogonal the central axis, at least one of the opposed side surfaces being a diffusively reflective surface;

an auxiliary lighting assembly retained in the channel, the auxiliary lighting assembly comprising:

a light source disposed in the channel and arranged to emit light in a direction orthogonal to the central axis and toward one of the opposed side surfaces of the channel; and a light transmissive substrate comprising opposed first and second major surfaces spaced apart from one another in a thickness direction, an inner edge surface extending between the first and second major surfaces in the thickness direction, and an outer edge surface opposed the inner edge surface and extending in the thickness direction, the inner edge surface of the light transmissive substrate in contact with one of the opposed side surfaces of the channel, the outer edge surface of the light transmissive substrate in contact with the other of the side surfaces of the channel, wherein the first and second major surfaces of the light transmissive substrate define a light emission portion, and an extension portion extends from the light emission portion proximate the second major surface in the thickness direction, and wherein the light source is attached to the extension portion.

10. A light head comprising:

a housing;

a primary light source attached to the housing; and an auxiliary lighting assembly attached to the housing, the auxiliary lighting assembly comprising:

a light transmissive substrate extending along a length and comprising:

a light emission portion comprising opposed first and second major surfaces spaced apart from one another in a thickness direction, an inner edge surface extending between the first and second major surfaces in the thickness direction, and an outer edge surface opposed the inner edge surface and extending in the thickness direction; and an extension portion extending from the light emission portion proximate the second major surface in the thickness direction; and a light source attached to the extension portion, wherein the housing comprises a channel in which the auxiliary lighting assembly is retained, the inner edge surface of the light emission portion in contact with a side surface of the channel, the outer edge surface of the light emission portion in contact with an opposed side surface of the channel, and the light source disposed within the channel.

11. The light head of claim 10, wherein:

the primary light source is arranged proximate a first side of the housing; and the auxiliary lighting assembly is arranged proximate a second side of the housing opposite the first side.

12. The light head of claim 10, wherein the extension portion extends orthogonal to the major surfaces of the light emission portion.

13. The light head of claim 10, wherein a cross-section of the light transmissive substrate is an L shape.

14. The light head of claim 10, wherein the light source is disposed in the channel and arranged to emit light in a direction orthogonal to an axial direction of the housing.

15. The light head of claim 10, wherein the channel comprises the opposed side surfaces and a bottom surface, at least one of the opposed side surfaces being a diffusively reflective surface.

16. The light head of claim 10, wherein the inner edge surface of the light emission portion comprises a protrusion, and one of the side surfaces of the channel comprises a recess that mates with the protrusion.

17. The light head of claim 10, wherein the light transmissive substrate and the channel are each annular in shape.

18. The light head of claim 17, wherein the inner edge surface defines an orifice through the light emission portion.

19. The light head of claim 10, wherein the light transmissive substrate is a diffusive material.

20. The light head of claim 10, wherein the light transmissive substrate extends along the length in a closed loop.

21. The light head of claim 10, wherein the light transmissive substrate extends along the length between respective ends.

* * * * *